US006585049B2

(12) United States Patent
Leniek, Sr.

(10) Patent No.: US 6,585,049 B2
(45) Date of Patent: Jul. 1, 2003

(54) DUAL DISPLACEMENT PUMPING SYSTEM SUITABLE FOR FLUID PRODUCTION FROM A WELL

(76) Inventor: Humberto F. Leniek, Sr., 546 Hallie, Houston, TX (US) 77024

( * ) Notice: Subject to any disclaimer, the term of this patent is extended or adjusted under 35 U.S.C. 154(b) by 0 days.

(21) Appl. No.: 09/939,928

(22) Filed: Aug. 27, 2001

(65) Prior Publication Data

US 2003/0037929 A1 Feb. 27, 2003

(51) Int. Cl.[7] ..... E21B 43/40
(52) U.S. Cl. ..... 166/369; 166/105.5; 166/68
(58) Field of Search ..... 166/105.5, 106, 166/265, 313, 372, 373, 68, 69, 369, 370

(56) References Cited

U.S. PATENT DOCUMENTS

| | | | | |
|---|---|---|---|---|
| 4,476,923 A | | 10/1984 | Walling | 166/65 R |
| 4,863,991 A | | 9/1989 | Poppe et al. | 524/606 |
| 5,180,014 A | | 1/1993 | Cox | 166/384 |
| 5,511,619 A | | 4/1996 | Jackson | 166/369 |
| 5,667,369 A | | 9/1997 | Cholet | 417/448 |
| 5,692,562 A | | 12/1997 | Squires | 166/68.5 |
| 5,785,500 A | | 7/1998 | Leniek | 417/46 |
| 5,941,311 A | | 8/1999 | Newton | 166/369 |
| 6,092,600 A | * | 7/2000 | McKinzie et al. | 166/266 |
| 6,142,224 A | * | 11/2000 | Stuebinger et al. | 166/105.5 |
| 6,173,768 B1 | * | 1/2001 | Watson | 166/68 |
| 6,186,238 B1 | | 2/2001 | Tornquist | 166/369 |
| 6,220,358 B1 | * | 4/2001 | Leniek, Sr. | 166/369 |

OTHER PUBLICATIONS

*Use Of Small Diameter Casing Reduces Well Costs,* M. H. Stekoll et al., World Oil, Feb. 1, 1959, pp. 70–74.

* cited by examiner

*Primary Examiner*—Frank Tsay
(74) *Attorney, Agent, or Firm*—Conley Rose, P.C.

(57) ABSTRACT

A dual displacement pumping system is disclosed. In one embodiment, the system includes a subsurface pump, a tubing string, and a surface pumping unit connected to the subsurface pump by a reciprocating member. The subsurface pump includes a pump barrel mounted to the end of the tubing string, and a plunger mounted to the end of the reciprocating member. Valves cause downward motion of the plunger in the pump barrel to force fluid from the lower end of the pump barrel into the reciprocating member, and fill the upper end of the pump barrel with well bore fluid. They also cause upward motion of the plunger to force fluid from the upper pump barrel into the tubing string, and fill the lower pump barrel with well bore fluid. Thus, both pumping movements are exploited, nearly doubling the volume of fluid pumped with a conventional surface configuration.

19 Claims, 2 Drawing Sheets

120
122
126
118
124
110
130
134
132
104
106
114
102
108
112
116

120
218
110
130
134
132
104
106
114
102
108
215
112
116

DUAL DISPLACEMENT PUMPING SYSTEM SUITABLE FOR FLUID PRODUCTION FROM A WELL

CROSS-REFERENCE TO RELATED APPLICATIONS

The present application relates to U.S. patent application Ser. No. 09/775,246, filed Feb. 1, 2001, which is a continuation of issued U.S. Pat. No. 6,220,358. The present application further relates to Disclosure Document Nos. 487891; 488489; and 496525; respectively filed on Jan. 25, 2001, Feb. 6, 2001, and Jul. 2, 2001, with the U.S. Patent and Trademark Office under the Disclosure Document program. All of these references are hereby incorporated herein by reference.

BACKGROUND OF THE INVENTION

1. Field of the Invention

This invention relates generally to a system for pumping fluid from a well. More specifically, this invention relates to a system in which a dual-displacement, subsurface pump is driven by reciprocating motion of a sucker rod or tubing string, thereby producing fluid with both halves of the stroke cycle.

2. Description of Related Art

To extract fluids such as water or hydrocarbons from the earth, people traditionally drill a hole through overlying formations to the fluid-containing reservoir. If the fluid pressure in the reservoir is sufficient, the fluids will fill the hole and flow to the surface of their own accord. More commonly, however, fluids will enter the hole and remain pooled near the bottom. These fluids must be pumped to the surface.

Of particular interest to this disclosure are wells with high water/oil ratios and high fluid volumes. These may occur, for example, in secondary recovery oil wells where water is injected to "sweep" the last traces of hydrocarbons from a reservoir.

A popular pumping system for these wells includes an electric submersible pump. In this system, the pump is typically attached to the lower end of production tubing and submerged in the fluid. An electrical cable is typically attached to production tubing to supply power for the pump. However, for deeper wells, the installation of pumping system becomes cumbersome, requiring manual strapping of the cable to the production tubing, and careful insertion to avoid accidental severing of the cable downhole. Once in place, the power dissipation in the cable may become a significant portion of operational costs.

For most wells of this type, the traditional pumping system includes a single-displacement reciprocating pump. The pump is typically attached to the lower end of production tubing and submerged in the fluid. A sucker rod string extends through the production tubing between the pump and a surface pump unit on the surface. The surface pump unit reciprocates the sucker rod string to drive the single-displacement pump. Although reliable, this pumping system generally requires a large surface pumping unit, and it productively utilizes only one half of the pumping cycle.

An alternative pumping system that is sometimes employed for these wells is a progressive-cavity pumping system. In this system, a progressive-cavity pump is attached to the lower end of a sucker rod string and inserted through production tubing to be submerged in the fluid. The sucker rod string connects the pump to a surface pump unit.

The surface pump unit rotates the sucker rod string to drive the progressive cavity pump. Although these pumps can be run at high speed, such operation commonly causes failure in the sucker rod string. This failure is normally attributed to improper installation and/or inertial torque stresses. These systems are also subject to depth limitations.

Accordingly, a need exists for a pumping system that can operate reliably and more economically than existing pumping systems.

SUMMARY OF THE INVENTION

The problems outlined above are addressed by a dual-displacement pumping system. In one embodiment, the system includes a dual-displacement pump, a tubing string, and a surface pumping unit connected to the dual displacement pump by a reciprocating member. The reciprocating member is preferably a continuous tubing string, but a threaded tubing string or a sucker rod string with a hollow portion at its terminal end may alternatively be used. The dual displacement pump includes a pump barrel mounted to the end of the first tubing string, and a plunger mounted to the end of the reciprocating member. A valve configuration is provided so that downward motion of the plunger in the pump barrel forces fluid from the lower end of the pump barrel to enter the reciprocating member and from there, to travel to the surface. Downward motion of the plunger also fills the upper end of the pump barrel with fluid from the well bore. The valve configuration also causes upward motion of the plunger to force fluid from the upper end of the pump barrel to enter the tubing string (and travel thence to the surface), and causes the lower end of the pump barrel to fill with fluid from the well bore. In this fashion, both movements of the pumping cycle are fully exploited to nearly double the volume of fluid pumped with a conventional surface configuration.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENTS

Figure 1:
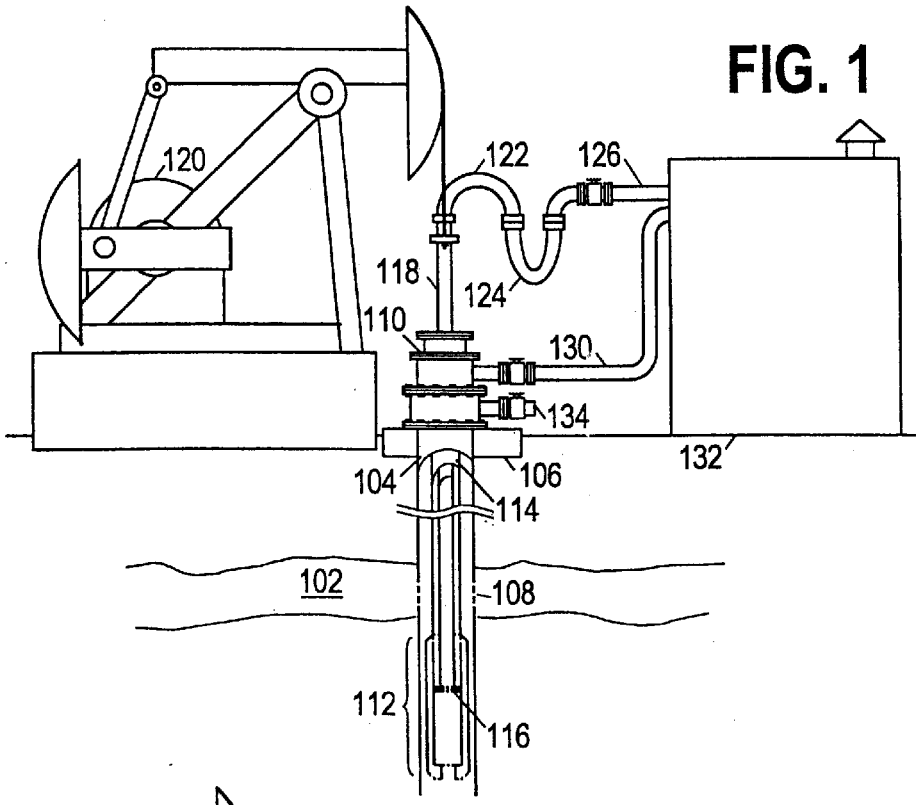
FIG. 1 is an overall view of a preferred pumping system embodiment using a reciprocated continuous tubing string.

Turning now to the figures, FIG. 1 shows a first pumping system embodiment. A well has been drilled through the earth to intersect a fluid reservoir 102. The well is generally lined with casing 104 that extends from the well head 106 to below the fluid reservoir 102. The casing 104 is perforated 108 where it intersects the reservoir to allow fluid to flow into the interior of casing 104. A blow-out preventer 110 is attached to the well head 106 for controlling fluid and gas flows from the well.

A pump body 112 is affixed to the lower end of a production tubing string 114 and lowered through the blow-out preventer 110 to be submerged in the fluid pooling at the bottom of the well. The production tubing is secured to the well head 106. Also, the pump body 112 is preferably set downhole using standard well servicing techniques. A pump plunger 116 is affixed to the bottom of a continuous tubing string 118 and lowered through the interior of the production tubing string until it is properly seated in pump body 112. A packing unit (not specifically shown) in blow out preventer 110 seals the gap between the continuous tubing 118 and the blow out preventer 110, but allows for vertical movement of the tubing 118. A surface pump unit 120 reciprocates (cyclically raises and lowers) the continuous tubing string 118, thereby reciprocating the plunger 116 in the pump body 112. As discussed in greater detail below, the reciprocation of the plunger 116 forces fluid upward through the continuous tubing string 118 and/or the production tubing string 114 to the surface.

The surface pump unit 120 shown in FIG. 1 employs a "walking beam" pump configuration to reciprocate continuous tubing string 118. It is recognized that other alternative pump configurations may be suitable for imparting reciprocative motion to a subsurface pump plunger (e.g., hydraulic pumping units), and these alternative configurations may be employed without departing from the underlying principles of the present invention.

Surface outflow from the continuous tubing string 118 is preferably conveyed to a fixed outflow passage 126 via a flexible high-pressure hose 124. A U-shaped tube 122 is preferably connected between the continuous tubing string 118 and the flexible hose 124 to minimize wear and fatigue in flexible hose 124. Surface outflow from the production tubing 114 exits through outflow passage 130. Outflow passages 126 and 130 may convey the fluid outflows to an aboveground storage tank 132. In a preferred embodiment, the pumping system produces fluid outflows through outflow passage 126 during downward motion of plunger 116, and produces fluid outflows through outflow passage 130 during upward motion of plunger 116. However, as explained in greater detail below, the fluid outflows may be entirely produced through the continuous tubing outflow 126 or entirely through the production tubing outflow 130. In either of these cases, both the upward and downward motions of the plunger 116 contribute to the overall fluid outflow.

Also shown in FIG. 1 is a ball valve 134 that controls surface flow to and from the casing interior. This may be used to open the casing interior to the ambient air during the initial "priming" of the well (i.e., the initial fluid fill of the tubing) to prevent an excessive pressure differential from being built up across the subsurface pump, as this could prevent the "prime" from being established.

Figure 2:
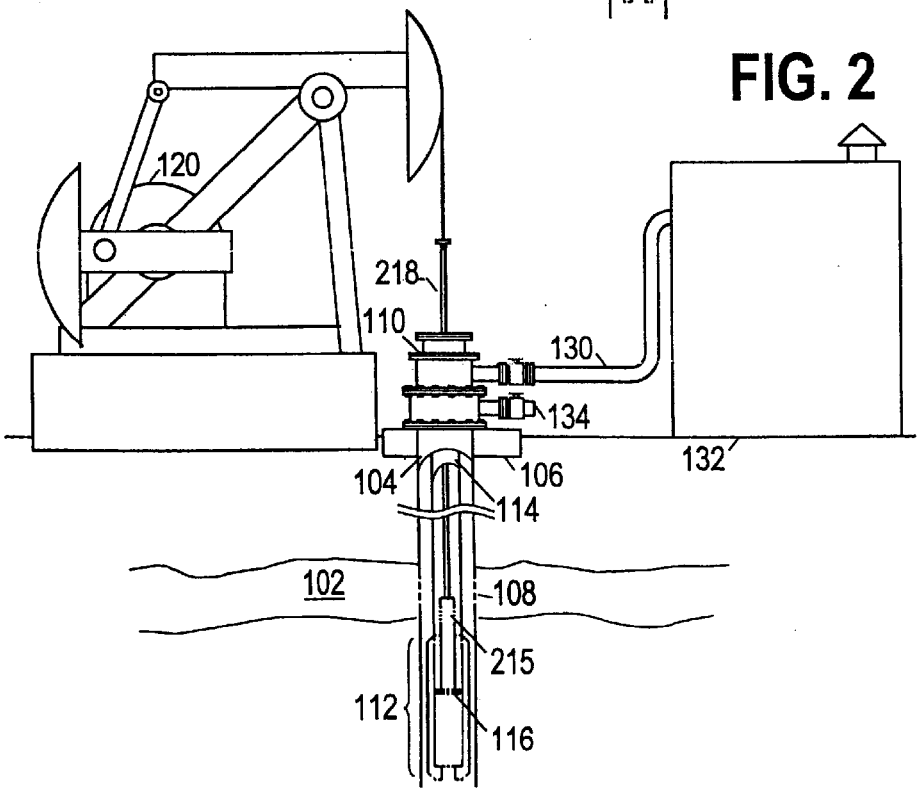
FIG. 2 is an overall view of a preferred pumping system embodiment using a reciprocated sucker rod string.

FIG. 2 shows an alternate pumping system embodiment that replaces the continuous tubing string 118 with a solid sucker rod string 218 that reciprocates in the same manner. A similar subsurface pump configuration is used. The pump plunger 116 is coupled to the sucker rod string 218 by a short tubing section 215. Downward motion of the plunger 116 forces fluid from a chamber defined by the pump body 112 into the short tubing section 215. The short tubing section 215 is preferably perforated above the pump body 112 to allow fluid from the tubing section 215 to flow to the surface through the production tubing 114.

Figure 3:
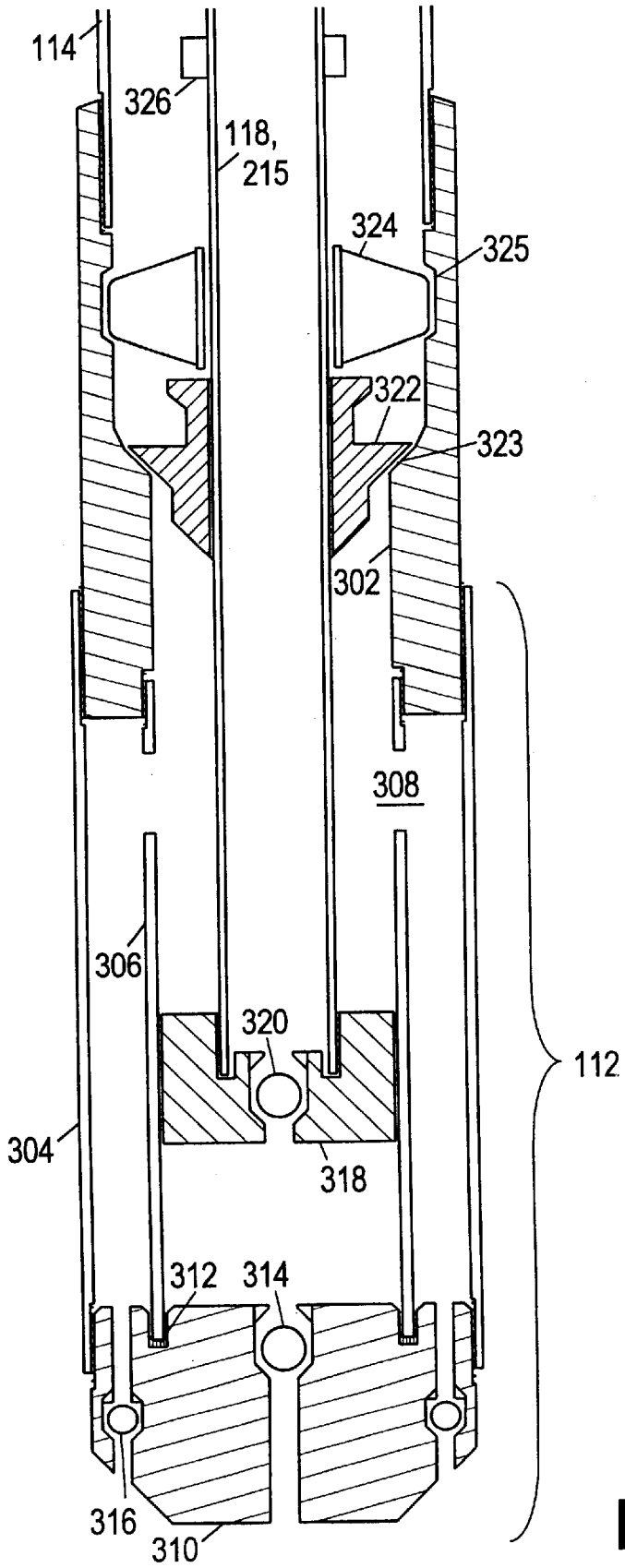
FIG. 3 is a cross-sectional side view of a preferred embodiment a subsurface pump; and While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

FIG. 3 shows a preferred subsurface pump configuration for use with either of the pumping systems shown in FIGS. 1 and 2. For clarity, however, the ensuing discussion will focus solely on the embodiment that employs a continuous tubing string, but it is recognized that the continuous tubing string may be replaced by a sucker rod string with a hollow terminal portion.

A coupler 302 connects the pump body 112 to the production tubing 114. The pump body 112 includes an outer shell 304, a pump barrel 306, and an end cap 310. A seal 312 prevents fluid leakage between the pump barrel 306 and end cap 310. Outer shell 304 is preferably a threaded cylinder concentric with the pump barrel 306.

The complete pump configuration includes a pump plunger 318 coupled to the lower end of continuous tubing 118 (or to the lower end of short tubing section 215). A check valve 322 is movably mounted on the continuous tubing 118 above the plunger 318. Between the check valve 322 and the continuous tubing string 118 is a sealing layer that allows axial motion but prevents fluids from passing between the valve and continuous tubing string. When the plunger 318 is lowered into the pump barrel 306, the check valve 322 preferably rests on a valve seat 323 formed by coupler 302. The contact surfaces of the check valve 322 and coupler 302 may be conical or spherical sections.

Loosely mounted on the continuous tubing 118 above the check valve 322 is a centralizer 324. The centralizer 324 preferably has three or more fins that fit within a landing nipple 325 attached to the bottom of production tubing 114. (In an alternative embodiment, the fins may simply provide a tight frictional fit against the inside of production tubing 114.) A coupling 326 (or fins, latches or other projections) is located on the continuous tubing 118 above the centralizer 324. As the continuous tubing is through the production tubing 114, the coupling 326 forces the centralizer 324 along before it.

During the installation of the subsurface pump, the pump body 112 is lowered into the well on the end of the production tubing 114. After the pump body 112 has been placed at the desired depth, the plunger 318, check valve 322, centralizer 326, and coupling 326, are lowered on the end of continuous tubing 118 through the interior of the production tubing 114 until the plunger 118 enters the pump barrel 306. Once the plunger 318 enters the pump barrel 306, the check valve 322 rests on the valve seat 323. The continuous tubing 118 is lowered until the centralizer 324 is forced into place just above the check valve 322. This position of the continuous tubing 118 represents the lowest allowable stroke position. Thereafter, as the continuous tubing 118 is reciprocated, the fit between the centralizer 324 fins and the landing nipple 325 holds the centralizer 324 in place.

Once the plunger 318 is in place in the pump barrel 306, two chambers are defined. The first chamber is defined in the pump barrel 306 below the plunger 318. An inlet check valve 314 is provided in end cap 310 to fill the first chamber with fluid from the well bore as the plunger 318 is raised. An outlet check valve 320 is provided in plunger 318 to transfer the fluid from the first chamber to the interior of the continuous tubing string 118 as the plunger 318 is lowered. The fluid transferred to the continuous tubing string forces a similar quantity of fluid from the top of the continuous tubing string 118 at the surface.

The second chamber is defined in the annulus between the pump barrel 306 and the continuous tubing 118. Check valve 322 operates as an outlet check valve to transfer fluid from the second chamber to the interior of the production tubing string 114 as the plunger 318 is raised. The transferred fluid forces a similar quantity of fluid from the top of the production tubing string 114 at the surface. Note that centralizer 324 operates to "hold down" the check valve 322 as the plunger 318 is raised. This keeps the check valve 322 near the seat 323 so that the check valve 322 closes quickly at the beginning of the down stroke.

A set of one or more inlet check valves 316 is provided in the end cap 316 to fill the second chamber with fluid from the well bore as the plunger 318 is lowered. The second chamber is filled via an annular passage between the pump shell 304 and the pump barrel 306 that connects the set of inlet check valves 316 to perforations 308 at the upper end of pump body 306. The set of inlet check valves 316 are preferably evenly spaced about the circumference of the end cap 310.

In the embodiment of FIG. 3, the check valve 322 shown is of the traveling-valve type, with a hold down provided by the centralizer 324. One of ordinary skill in the art will recognize that alternative configurations are possible, including without limitation, a set of flapper valves, or a set of ball-and-seat valves. Each of these valve types opens in response to differential pressure in one direction, and closes in response to differential pressure in the opposite direction. In the same vein, the check valves 314, 316, and 320, are shown as ball-and-seat valves. One of ordinary skill in the art will recognize that one or more of these valves can be replaced with alternate check valve configurations such as, e.g., flapper valves.

Accordingly, the subsurface pump configuration described above is a dual-displacement pump. That is, fluid is forced to the surface on both the upward and downward movements of the pump stroke. Depending on the chosen dimensions of the described dual-displacement pump, this configuration advantageously pumps about 1.8 times the fluid volume per stroke as a single-displacement pumping system configuration, without a commensurate increase in effort. As an added advantage, existing wells can be modified by simply replacing the existing single-displacement pump with the described double displacement pump.

Various contemplated dimensions for the dual-displacement pump are now provided, but these dimensions may of course be altered without departing from the underlying principles of the invention. The casing 104 may be of any standard size, although it is preferred that the minimum inner diameter be no less than five inches. The production tubing string 114 is preferably 2⅞ or 3½ inch tubing. The continuous tubing string 118 is preferably between about one- and two-inch tubing. The pump 306 barrel preferably has an interior diameter of more than 1.5 inches, and a length of more than about seventy-four inches. The pump shell 304 preferably has an exterior diameter of more than about three inches.

Of course, the dual-displacement pump configuration shown in FIG. 3 is only one of many variant configurations which may be used without departing from the scope of the attached claims. Other valve locations and configurations may be used. For example, the pump shell 304 may be eliminated and inlet check valves 316 located in coupler 302. Additionally or alternatively, the outlet check valve 322 may be replaced with a locking pump lid, and outlet check valves placed in plunger 318 to transfer fluid from the second chamber to the interior of the continuous tubing string 118 when the plunger 318 is raised.

Numerous advantages may be obtained by using the disclosed pumping system. For example, existing well head and short stroke pumping units may be used, thereby eliminating any retrofitting requirements for a different artificial lift system such as electric submersible pumps, progressive cavity pumps, or even large capacity, long stroke pumping units.

Another advantage which may be obtained from the disclosed pumping system is the ability to pump fluid from a multilayered reservoir without losing the opportunity to avoid gas lock by unloading or venting undesired gas through the annular space. Fluids from the multiple layers are allowed to flow down the annulus between the casing and the tubing string and to submerge the pump. Gasses flow up the annulus and may be removed from the wellhead at the surface.

Advantageously, the disclosed pumping system is compatible with existing surface installations and equipment including well heads, production manifolds, prime movers and flow lines. The inclusion of the hydraulic hose assembly is considered to be a minor adaptation to any existing surface installation.

The availability of coiled tubing in different diameters, wall thickness and grades of steel, allows the disclosed pumping system to be adapted for various pump depths, various well fluids, and various pumping volumes.

Numerous variations and modifications will become apparent to those skilled in the art once the above disclosure is fully appreciated. For example, threaded tubing may be used in place of coiled tubing. The tubing may be made of steel or composite materials (composite tubing). In fact, for highly corrosive environments, composite tubing may be preferred.

Additionally, this pumping system may be powered by means other than a beam pumping unit. For example, a hydraulic pumping unit may replace the beam pumping unit. It is intended that the following claims be interpreted to embrace all such variations and modifications.

What is claimed is:

1. A dual displacement pump comprising:

a pump body that attaches to a tubing string, wherein the pump body includes a pump barrel;

a plunger that attaches to a tube inside the tubing string, wherein the plunger is configured to reciprocate inside the pump barrel when the tube is reciprocated, wherein the plunger divides the pump barrel into a first chamber and a second chamber, wherein motion of the plunger in a first direction forces fluid from the first chamber to enter the tube and draws well bore fluid into the second chamber, and wherein motion of the plunger in a second direction opposite the first direction forces fluid from the second chamber to enter an annulus between the tube and the tubing string, and draws well bore fluid into the first chamber.

2. The pump of claim 1, further comprising:

a traveling valve that surrounds the tube above the plunger and operates as a substantially one-way check valve that passes fluid from the second chamber to said annulus.

3. The pump of claim 2, further comprising:

a centralizer that surrounds the tube above the traveling valve and operates to limit upward motion of the traveling valve.

4. The pump of claim 3, further comprising:

one or more latches on the surface of the tube above the centralizer, wherein the latches operate to place the centralizer in position in a landing nipple near the lower end of the tubing string when the tube is lowered into the tubing string.

5. The pump of claim 3, further comprising:

one or more projections from the surface of the tube above the centralizer, wherein the centralizer fits frictionally against the interior of the tubing string, and wherein the projections operate to force the centralizer into operating position when the tube is lowered into the tubing string.

6. The pump of claim 1, wherein the pump body further includes:

a pump shell that encloses the pump barrel;

an end cap that seals the lower end of the pump shell and the lower end of the pump barrel, wherein the end cap includes:

a first inlet check valve for the first chamber; and a second inlet check valve for the second chamber, wherein the pump shell defines a closed fluid passage between the second inlet check valve and the second chamber, and wherein the pump barrel includes one or more openings between the second chamber and the closed fluid passage.

7. The pump of claim 6, wherein the pump shell is a cylinder concentric with the pump barrel.

8. The pump of claim 6, wherein the check valves are ball-and-seat valves.

9. The pump of claim 6, wherein the check valves are flapper valves.

10. The pump of claim 6 wherein the end cap includes multiple inlet check valves for the second chamber.

11. The pump of claim 6, wherein the plunger includes an outlet check valve for the first chamber.

12. A method of pumping fluid from a well, the method comprising:

repeatedly moving a plunger in a pump barrel in a first direction to force fluid from a first chamber in the pump barrel to pass through production tubing to the surface; and repeatedly moving the plunger in a second direction opposite the first direction to force fluid from a second chamber in the pump barrel to pass through the production tubing to the surface.

13. The method of claim 12, further comprising:

installing a dual displacement pump in the well, wherein said installing includes:

attaching a pump body that includes the pump barrel to a production tubing string;

inserting the pump body and production tubing string into the well;

mounting a check valve and a plunger on a reciprocating member; and inserting the reciprocating member into the production tubing string so that the plunger is positioned in the pump barrel and the check valve is seated atop the second chamber.

14. The method of claim 13, wherein the reciprocating member is a solid sucker rod string.

15. The method of claim 13, wherein the reciprocating member is a hollow tubing string that carries fluid forced from the first chamber to the surface.

16. A pumping system which comprises:

a subsurface pump configured for dual-displacement operation;

a reciprocating member configured to drive the subsurface pump; and a surface pumping unit configured to repeatedly raise and lower the reciprocating member, wherein the reciprocating member is a tubing string.

17. A pumping system which comprises:

a subsurface pump configured for dual-displacement operation;

a reciprocating member configured to drive the subsurface pump; and a surface pumping unit configured to repeatedly raise and lower the reciprocating member, wherein the subsurface pump includes:

a pump body having:

a pump barrel having an upper end and a lower end;

a pump shell that encloses the pump barrel to define a fluid passage from the lower end of the pump barrel to the upper end of the pump barrel;

a coupler that couples the upper end of the pump barrel and the pump shell to a production tubing string; and an end cap that closes the lower end of the pump barrel and the pump shell, wherein the end cap includes a first inlet check valve for transferring fluid into the lower end of the pump barrel, and wherein the end cap includes a second inlet check valve for transferring fluid into upper end of the pump barrel via the fluid passage; and a plunger attached to the reciprocating member and movable positioned in the pump barrel, wherein the plunger includes an outlet check valve configured to transfer fluid from the lower end of the pump barrel into a hollow portion of the reciprocating member.

18. The system of claim 17 wherein the subsurface pump further includes:

a second outlet check valve movably mounted on the reciprocating member above the plunger, wherein the second outlet check valve is configured to transfer fluid from the upper end of the pump barrel into the production tubing string.

19. The system of claim 18, wherein the inlet check valves and plunger's outlet check valve are ball-and-seat valves, and wherein the second outlet check valve is a traveling valve.

* * * * *